US007665515B2

(12) United States Patent
Mullins

(10) Patent No.: US 7,665,515 B2
(45) Date of Patent: Feb. 23, 2010

(54) CASING AND DRILL PIPE FILLING AND CIRCULATING METHOD

(76) Inventor: Albert Augustus Mullins, 408 Caney St., Boling, TX (US) 77420

( * ) Notice: Subject to any disclaimer, the term of this patent is extended or adjusted under 35 U.S.C. 154(b) by 237 days.

(21) Appl. No.: 11/450,844

(22) Filed: Jun. 9, 2006

(65) Prior Publication Data

US 2006/0278402 A1 Dec. 14, 2006

Related U.S. Application Data

(60) Provisional application No. 60/689,514, filed on Jun. 10, 2005.

(51) Int. Cl.
*E21B 19/18* (2006.01)

(52) U.S. Cl. ..... 166/90.1

(58) Field of Classification Search ..... 166/90.1, 166/380, 177.4
See application file for complete search history.

(56) References Cited

U.S. PATENT DOCUMENTS

| | | | | |
|---|---|---|---|---|
| 3,265,431 | A | 8/1966 | Burner | |
| 4,800,966 | A * | 1/1989 | Parant et al. | 175/73 |
| 4,997,042 | A | 3/1991 | Jordan et al. | |
| 5,191,939 | A | 3/1993 | Stokley | |
| 5,735,348 | A | 4/1998 | Hawkins, III | |
| 5,971,079 | A | 10/1999 | Mullins | |
| 6,173,777 | B1 | 1/2001 | Mullins | |
| 6,309,002 | B1 | 10/2001 | Bouligny | |
| 6,390,190 | B2 | 5/2002 | Mullins | |
| 6,415,862 | B1 | 7/2002 | Mullins | |
| 6,443,241 | B1 | 9/2002 | Juhasz et al. | |
| 6,578,632 | B2 | 6/2003 | Mullins | |
| 6,604,578 | B2 | 8/2003 | Mullins | |
| 2003/0221519 | A1 * | 12/2003 | Haugen | 81/57.15 |
| 2004/0020692 | A1 * | 2/2004 | McAllister et al. | 175/171 |
| 2008/0196556 | A1 * | 8/2008 | Belik | 81/57.35 |

FOREIGN PATENT DOCUMENTS

| | | | |
|---|---|---|---|
| EP | 285 386 | A2 | 10/1988 |
| GB | 2406112 | | 3/2005 |
| WO | WO 01/71154 | A1 | 9/2001 |
| WO | WO 2004/101417 | A2 | 11/2004 |

OTHER PUBLICATIONS

Tesco; Bulletin 41000e; Casing Drive System; 4 pages.
National Oilwell Varco; CRT=350 Casing Running Tool; http://www.nov.com/Products.aspx?Puid=ATLRjQq$1se9oD &nodeId=SHDQDPGKPDXG...; 4 pages.
Murray, Paul; "Drilling crews can operate new casing running tool, resulting in lower costs", Drilling Contractor, Sep./Oct. 2005, 46-48.

* cited by examiner

*Primary Examiner*—Daniel P Stephenson
(74) *Attorney, Agent, or Firm*—Duane Morris LLP

(57) ABSTRACT

An apparatus is disclosed for adapting a combination of well tubulars in a string to accept a single filling and circulation apparatus and to eliminate the need for bails and elevators. In addition an adapter and a new filling and circulation apparatus are disclosed.

17 Claims, 7 Drawing Sheets

CASING AND DRILL PIPE FILLING AND CIRCULATING METHOD

PRIORITY INFORMATION

This application claims the benefit of U.S. Provisional Application No. 60/689,514, filed on Jun. 10, 2005.

FIELD OF THE INVENTION

The field of this invention relates to handling, filling, circulating or taking returns from a tubular string while it is being removed from or advanced into the well bore.

BACKGROUND OF THE INVENTION

Tubulars for a well bore are assembled at the surface as single joints are added and the tubular string is lowered into the well bore. As the joints are added at the surface on the rig floor, it is sometimes desirable to fill the tubular. Filling the tubular before it is run into the well bore prevents pressure imbalances on the tubular as it is being advanced into the well bore. Additionally, once the tubular is filled, it may be desirable to circulate through the tubular string as it is advanced into the well bore.

Casing is often run into the well bore as a liner. Liners of the desired length are advanced into the well bore as a casing string then attached to a hanger. The liner is further advanced into the well bore using the tubular string normally used to drill the well. Liners are advanced to a point near the bottom of the previously run casing string and cemented in the newly drilled portion of the well bore.

In addition to the cases cited above, the casing or drill string being advanced into the well bore may fit so tightly into the casing previously cemented in the well or the open hole below the previously run casing string that a pressure surge would be generated below the casing shoe or bottom hole assembly of a drill string. This is very undesirable since this pressure surge could break down an open formation causing loss of drilling fluid and/or loss of control of the well. To reduce the surge pressure it may be desirable to use a float shoe or valving in a drill string that allows well fluid to enter the casing and/or the drill string as they are being advanced into the well bore. To handle the fluid entering the casing, the fluid must be captured at the surface as it flows from the tubular string and returned to the mud system otherwise the fluid would spill on the rig floor and into the environment.

Prior devices have been developed to fill the casing and to circulate it and devices have been developed to fill the drill string and circulate it. These apparatus are illustrated in U.S. Pat. Nos. 4,997,042; 5,191,939; 5,735,348; 5,971,079 and 6,173,777 are apparatus to fill and circulate the casing; apparatus illustrated in U.S. Pat. Nos. 6,390,190; 6,415,862; 6,578,632 and 6,604,578 are to fill and circulate the drill string.

Currently, one of the above mentioned apparatus would be rigged up then used for advancing the casing into the well bore then removed from the rig. Another apparatus would then be rigged up to provide a means for advancing the drill string into the well bore. Currently none of the apparatus illustrated in the forgoing patents are able to fill, circulate and take returns from both the casing and drill string. In addition to the circulating apparatus change from casing to drill pipe the handling systems used on the top drive or traveling block must also be changed. That is to say casing elevators are removed and replaced by drill pipe elevators. This change over require substantial time when it is most critical to keep the tubular string moving (part of the tubular is in the open hole).

Some of these apparatus are attached to and held in place by a top drive or traveling block at the upper end and seal on or in the tubular at the lower end of the apparatus. When pressure is applied to the tubular through these apparatus a force is applied upward on the apparatus and downward on the tubular. This force will add to the load carried by the bails and elevators used to support the tubular and may cause an overload condition on these pieces of equipment.

Accordingly, it is an object of the present invention to provide an apparatus and means for filling and circulating any combination of tubular advanced into are removed from the well bore utilizing the same fill or circulation apparatus while changing the thread protector having a special internal profile.

Accordingly, it is an objective of the present invention to replace the bails and elevators used to handle the tubular while advancing/removing it in/from the well bore.

Accordingly, it is an objective of the present invention to eliminate the loading of the load carrying equipment (elevators, bails, traveling block or top drive).

SUMMARY OF THE INVENTION

An apparatus is disclosed for adapting a combination of well tubulars in a string to accept a single filling and circulation apparatus and to eliminate the need for bails and elevators. In addition an adapter and a new filling and circulation apparatus are disclosed.

DETAILED DESCRIPTION OF THE PREFERRED EMBODIMENT

Figure 1:
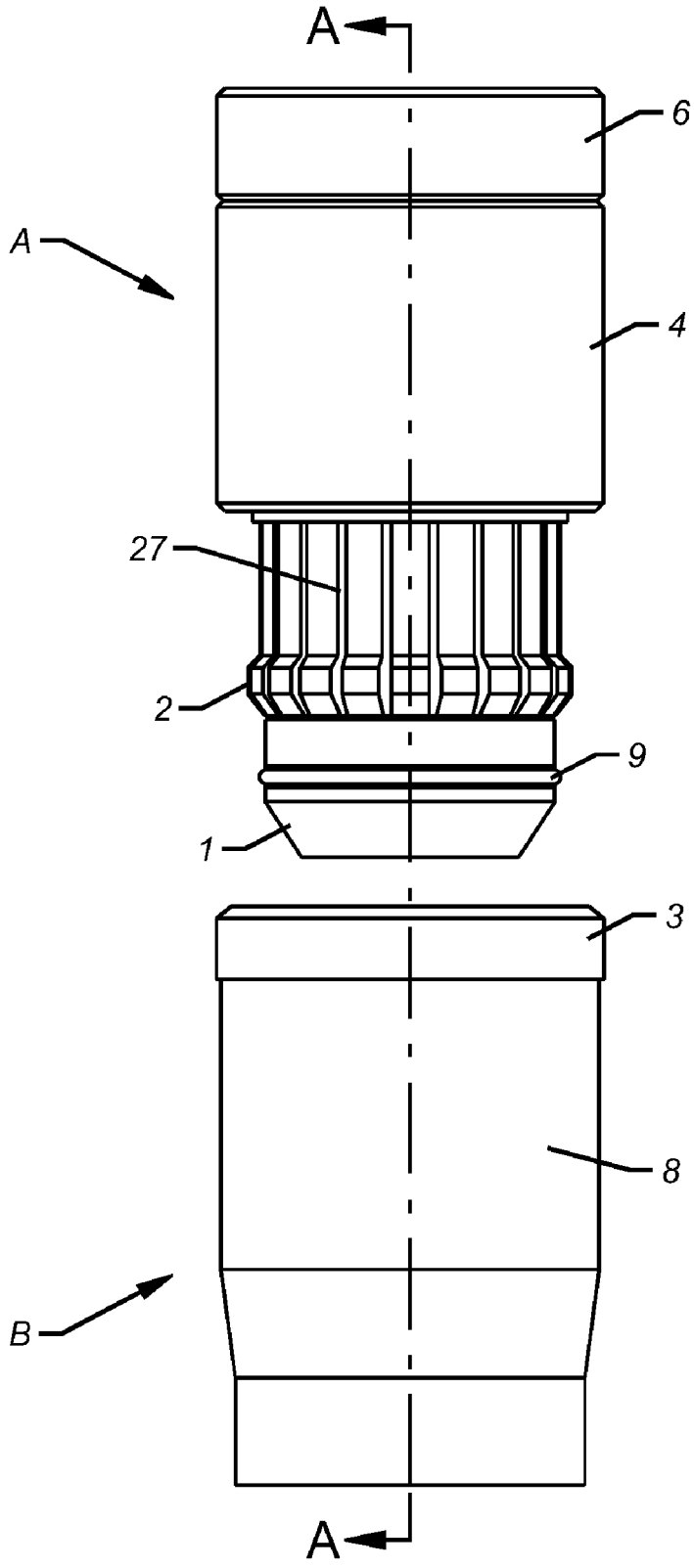
FIG. 1 is an exploded view of the apparatus for filling a tubular and the associated thread protector.

Referring to FIG. 1, the apparatus A is supported from a top drive (not shown), traveling block (not shown), or by an apparatus such as the frame mounted device disclosed in U.S. Pat. No. 6,578,632 (not shown). Apparatus A has a top sub 6 connectable to the mud system through a top drive or frame mounted unit (not shown). A housing 4 covers a piston (not shown), spring (not shown) and the upper end of a latch 2 the purposes of all which will be explained fully. The latch 2 is constructed so that the lower end has fingers formed by longitudinal slots 27 in the lower portion of latch 2. These fingers are manufactured so as to be biased to the expanded and locked position. There also exists a mandrel 1 connected to the top sub 6 and having a seal 9 to seal in apparatus B. There is a through bore in apparatus A to allow the flow of well fluid.

The bore of apparatus A could also contain a mud saver valve to prevent fluid from falling to the rig floor or into the environment when apparatus A is disconnected from apparatus B.

A thread protector 3 of apparatus B contains surfaces to accept the latch 2 and seal 9 of apparatus A. There is a through bore in thread protector 3 and tubular 8 to allow the flow of well fluid through the entire length of the tubular 8.

Figure 2:
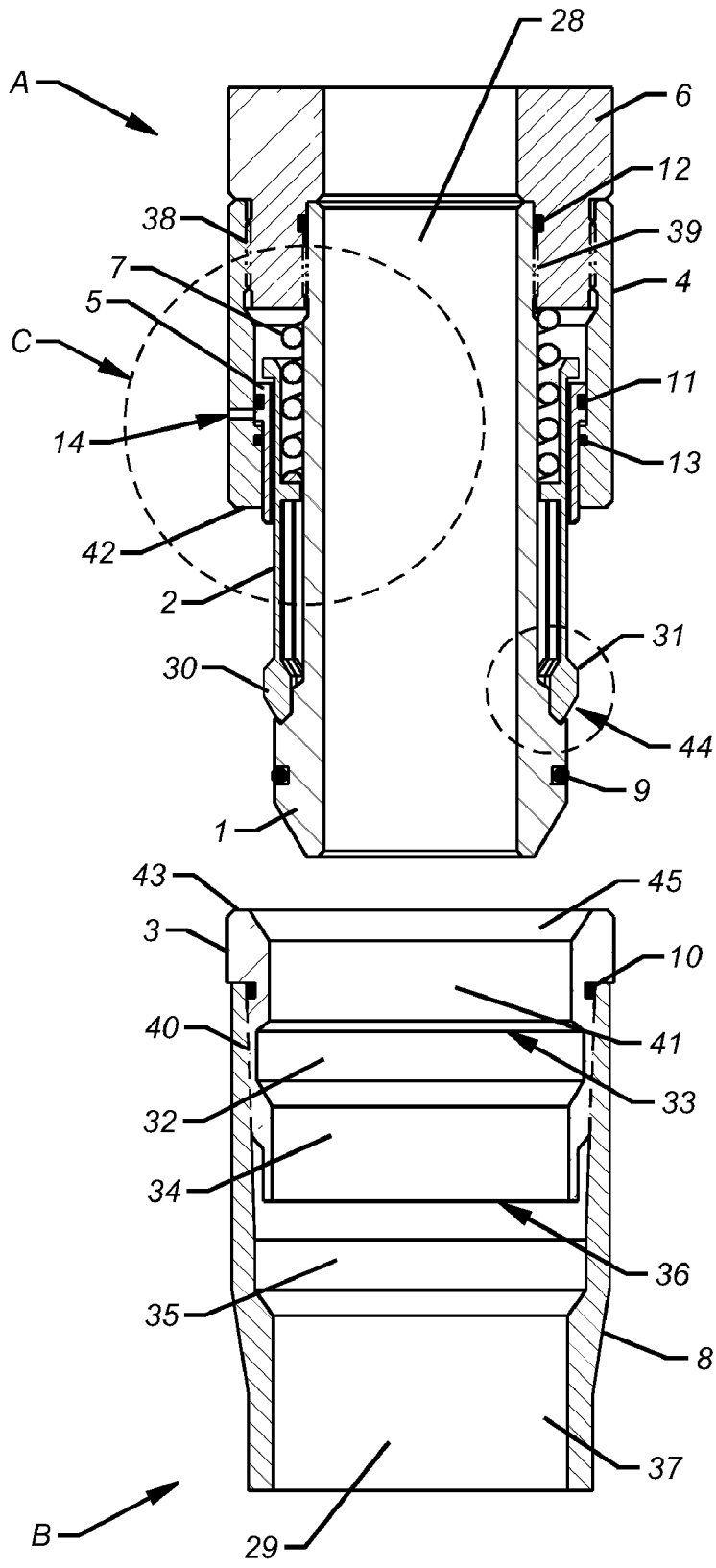
FIG. 2 is a sectional view of FIG. 1 showing apparatus for filling and associated thread protector.
Figure 2A:
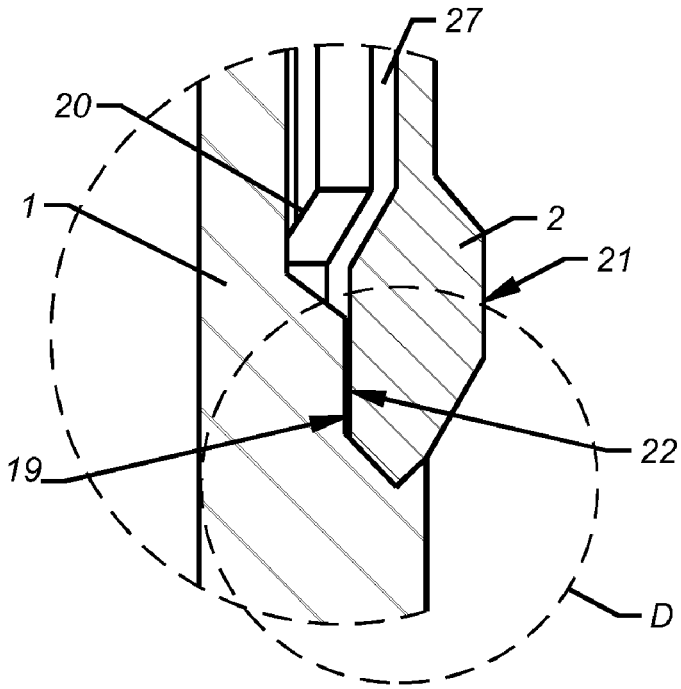
FIG. 2*a* is a detail view of the latch portion of FIG. 2.
Figure 2C:
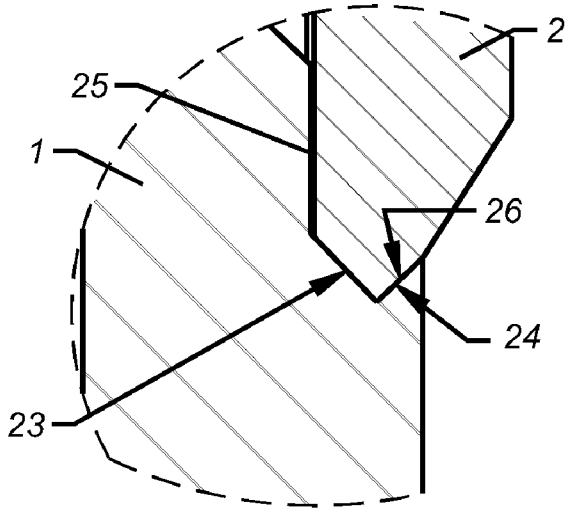
FIG. 2*c* is a detail view of the lower end of the latch portion of FIG. 2*a*.

Referring now to FIG. 2, a cross section of apparatus A and B as seen disconnected as in FIG. 1. Apparatus A has a central through bore 28 and apparatus B has a central through bore 29.

Figure 2B:
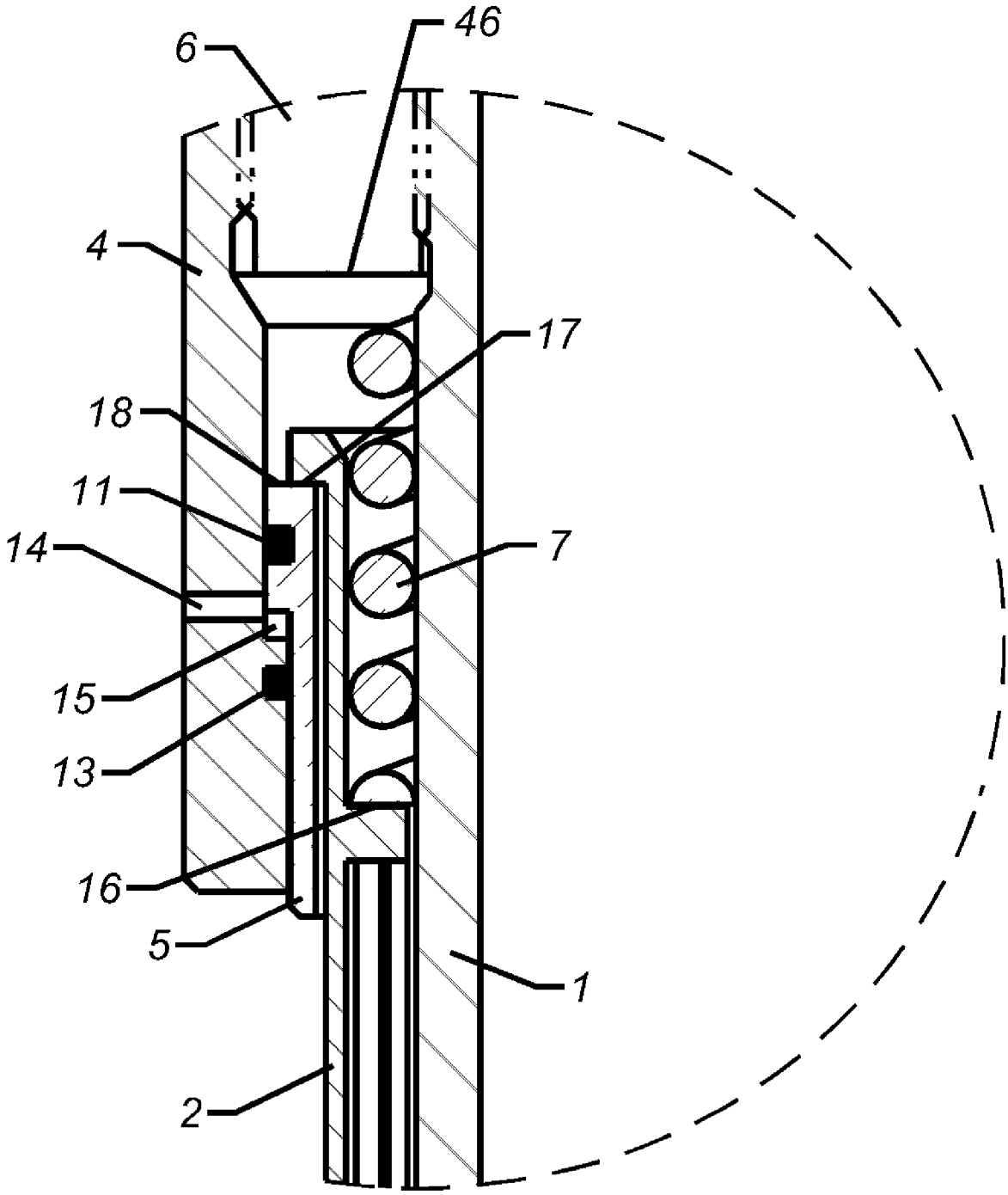
FIG. 2*b* is s detail view of piston and spring portion of FIG. 2.

In apparatus A, top sub 6 is connected to mandrel 1 by threads 39. A seal 12 is located between top sub 6 and mandrel 1. Seal 9 is located on mandrel 1 for sealing into apparatus B. Housing 4 is attached to the top sub 6 by threads 38. A piston 5 is located inside of housing 4 and operable by application of pressure through port 14. A piston chamber (15 better seen in FIG. 2*b*) is formed between the housing 4 and piston 5 by seal 13 and seal 11. Latch 2 is mounted inside of piston 5 in such a manner such that upward movement of piston 5 will raise latch 2, operation of the latch 2 will be explained later. Spring 7 is located at the upper end of latch 2 and in the annular area formed by latch 2 and mandrel 1. Spring 7 urges latch 2 and piston 5 downward to the normally locked position. In its normal position the lower end of the latch 2, upset 30 will be fully expanded as shown in this illustration.

Apparatus B consists of tubular 8 and thread protector 3. Tubular 8 can be supported by the elevators (not shown) of a rig hoisting system (top drive or traveling block). The tubular 8 and thread protector 3 are threadedly attached by threads 40. There can be a seal 10 between thread protector 3 and tubular 8. Seal 10 will not be required when thread protector 3 forms a seal with tubular 8.

Figure 3:
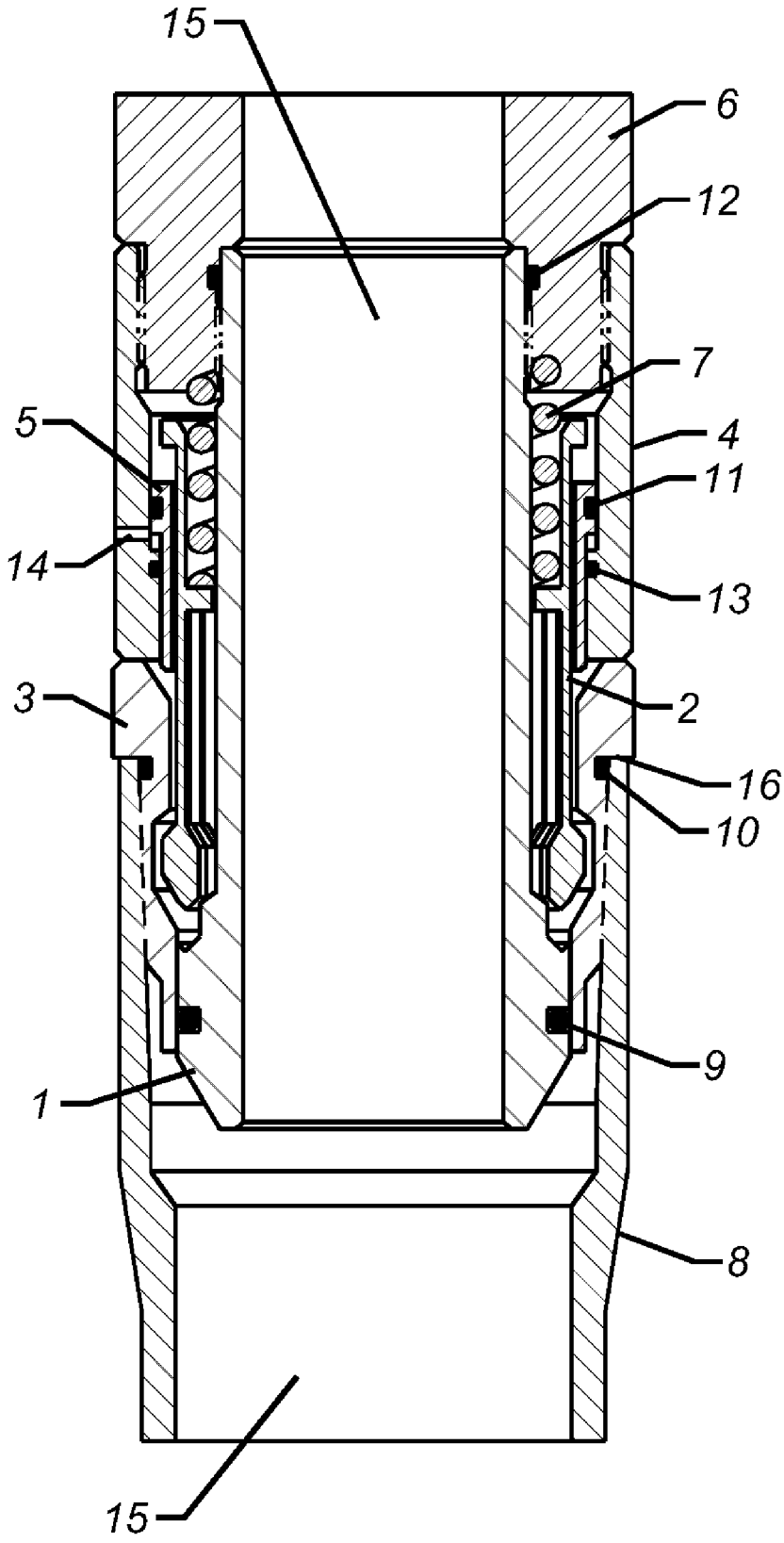
FIG. 3 is a sectional view of the apparatus in FIG. 1 fully inserted into the thread protector portion.

Referring now to FIG. 2 and FIG. 3, as apparatus A is lowered into apparatus B shoulder 44 of latch 2 of apparatus A will contact surface 45 of apparatus B forcing latch 2 to its upper position compressing spring 7. The upward movement of latch 2 allowing upset 30 of latch 2 to collapse so that upset 30 will pass through bore 41 of thread protector 3. When housing shoulder 42 contacts thread protector shoulder 43, upset 30 reaches groove 32 of the thread protector 3 and upset 30 will expand into groove 32. At the same time seal 9 will pass into the lower end of the thread protector 3 and seal in bore 34. Apparatus A would be held in sealing contact with thread protector 3 by latch shoulder 31 being located behind shoulder 33 of the thread protector 3. The advantage to this arrangement is that latch grooves and seal surfaces are part of the apparatus making them maintainable and very reliable for higher pressures and loads.

Figure 4:
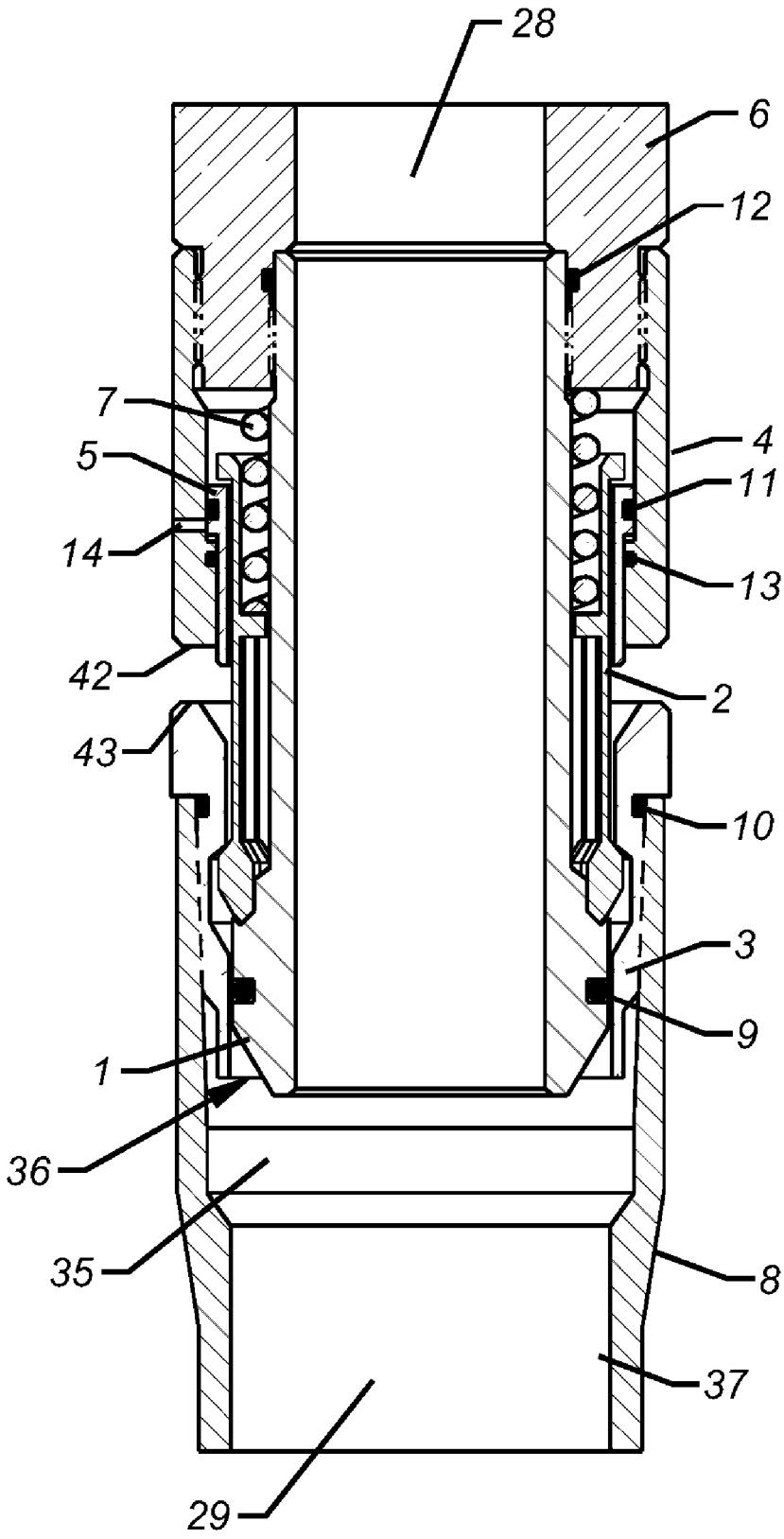
FIG. 4 is a sectional view of the apparatus in FIG. 1 in a position to carry the load of the tubular string and to provide for filling the tubular.

Referring to FIG. 4, apparatus A is shown inserted into apparatus B in the position where the latch 2 is fully engaged in the thread protector 3 and seal 9 is sealing in the lower end of thread protector 3. In this position the tubular can be filled, circulated and fully supported by the disclosed arrangement.

Figure 5:
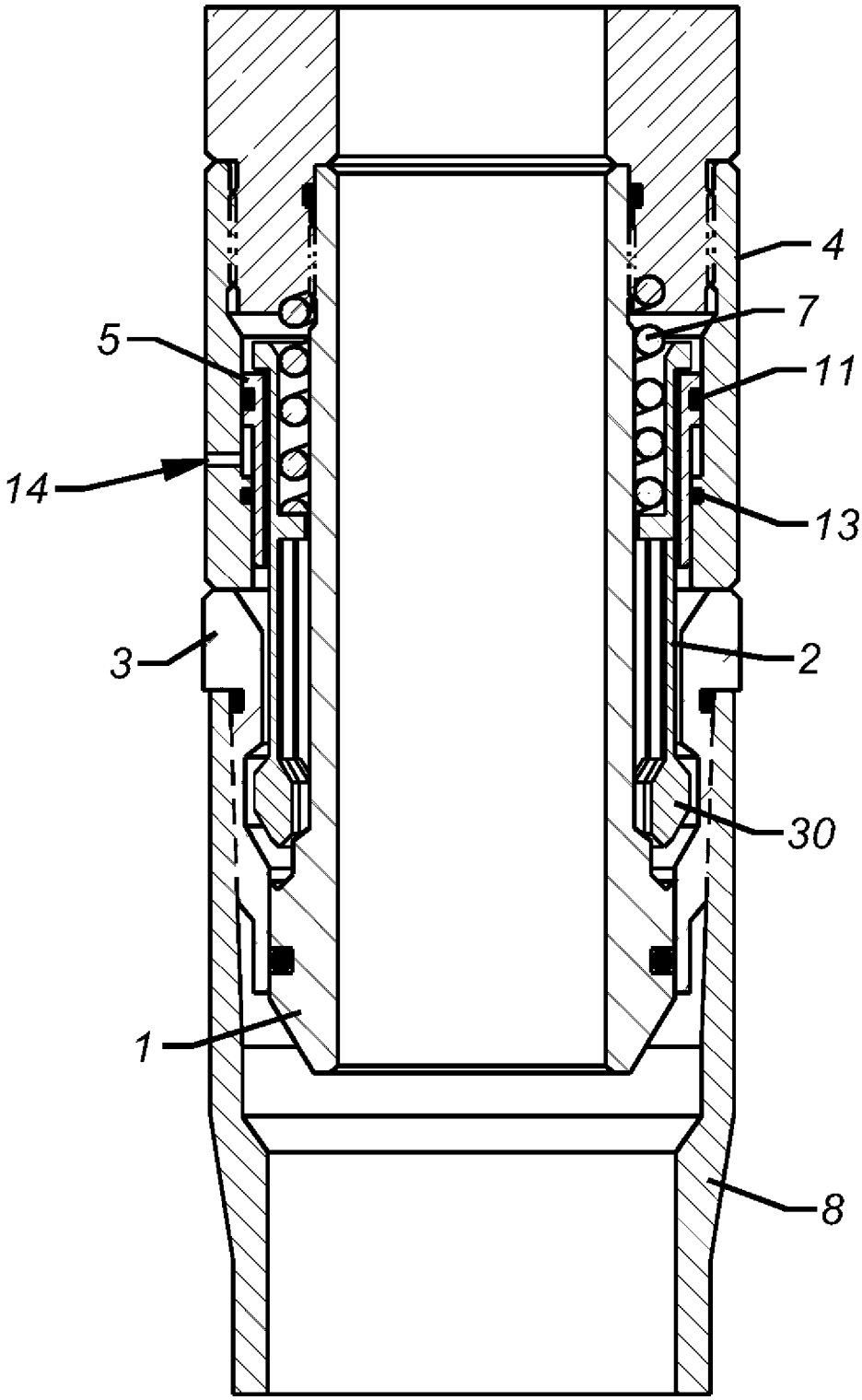
FIG. 5 is a view of FIG. 4 ready for release.

Referring to FIG. 5, apparatus A is shown with no internal pressure and the tubular 8 supported by slips set at the rig floor (not shown) and with weight applied to apparatus A forcing apparatus A fully into apparatus B. In this position shoulder 42 of housing 4 is in contact with shoulder. 43 of thread protector 3 (seen in FIG. 4). Pressure is applied to port 14 of housing 4 forcing piston 5 upward against latch 2 compressing spring 7 and moving latch 2 to the release position. As apparatus A is moved upward it will be removed from Apparatus A. Releasing pressure from port 14, spring 7 will force latch 2 against piston 5 forcing latch 2 and piston 2 to the normally latching position with upset 30 in the expanded position.

Those familiar with the art will recognize that by extending latch 2 and mandrel 1 upset 30 would be located into groove 35 formed between thread protector 3 and tubular 8 while seal 9 would be located in bore 37 of tubular 8. Latch surface 31 would then be held in place by shoulder 36 of thread protector 3. This would allow a standard type thread protector with no special profile to be used. There are advantages to this arrangement in that no seal 10 would be required regardless of the sealing arrangement between the thread protector 3 and tubular 8.

It is also recognized by those familiar with the art that when the apparatus A is attached to a top drive or traveling block and a thread protector 3 with an appropriate profile is threadedly attached to the upper most tubular in a tubular string, it is possible to lift and advance the entire tubular string while filling, circulating or taking returns from the tubular. This is a tremendous advantage in that the elevators and bails are eliminated while handling a tubular string and allows the tubular string to be landed nearer the rig floor making stabbing of the next tubular joint simpler and therefore safer for rig personnel. This also eliminates the need for having a casing elevator.

Seal 9 is depicted as a simple seal located in a groove, it is clear to those familiar with the art that this seal could be any of several types including a compressive or expandable seal known in the art as packer seals or a cup type seal commonly used in current fill-up and circulating equipment. This is not to restrict the type of seal used but to point out that there are many more seal arrangements which are envisioned and could be used.

Referring now to FIG. 3, apparatus A is shown inserted, locked and sealed into the thread protector 3 of apparatus B. It is clear to those familiar in the art that this arrangement of latching and sealing can withstand high pressures since the hydraulic forces generated by pressure across the area of seal 9 will be restrained by latch 2 in its mating groove of thread protector 3. It is also understood that this arrangement will also withstand high loads such as the weight of the tubular string as well as the generated load of pressuring the tubular.

Referring again to FIG. 1, those familiar with the art can understand that apparatus A could be the fill up apparatus disclosed in U.S. Pat. Nos. 6,415,862 or 6,604,578. in this case Apparatus B would consists of a thread protector 3 having an internal thread to accept the '862 or '578 apparatus and would be screwed into the tubular 8 upper internal thread. Tubular 8 would be supported by the elevators (not shown) which act to raise and lower the tubular as it is being advanced into a well bore if the frame mounted device of '632 is being used, otherwise there would be not elevator or bails and the '862 or '578 devices would be attached directly to the top drive or traveling block.

Referring again to FIG. 1, it is also evident to those familiar with the art that when the thread protector 3 has an internal thread profile the same as the drill string the Apparatus' disclosed in U.S. Pat. Nos. 6,415,862 or 6,604,578 would be the preferred tubular filling apparatus when attached to the top drive or a traveling block. This arrangement also provides for supporting the tubular string while providing for filling, circulation or handling returns from the tubular string. In this case the thread protector 3 would be used on the string not having the drill pipe connection.

Referring again to FIG. 1, it is also evident to those familiar with the art the thread protector 3 could be available in all tubular threads and that the apparatus A disclosed also provides for supporting the tubular string while providing for filling, circulation or handling returns from the tubular string. Again this allows for eliminating the bails and elevators.

The foregoing disclosure and description of the invention are illustrative and explanatory thereof, and various changes in the size, shape and materials, as well as in the details of the illustrated construction, may be made without departing from the spirit of the invention.

I claim:

1. A downhole completion method, comprising:

using common fill up and circulating equipment to run casing or drill string which has threads of different sizes;

providing a mandrel having a passage therethrough and having a gripping member on said equipment outside of said mandrel;

selecting an insert from a plurality of inserts for engagement with said gripping member in a passage through said selected insert which selected insert is uniquely configured to engage a predetermined sized casing or drill string thread.

2. The method of claim 1, comprising:

filling, circulating and taking returns from casing and drill string with common equipment.

3. The method of claim 2, comprising:

lifting or advancing an entire string while filling, circulating or taking returns through it.

4. The method of claim 1, comprising:

using an insert in the topmost tubular of casing or drill string to allow common equipment to handle different sizes.

5. The method of claim 4, comprising:

engaging a latch on the common fill up and circulating equipment within said insert.

6. The method of claim 5, comprising:

providing a seal adjacent said latch so that said latch when engaged removes pressure loads from said seal.

7. The method of claim 6, comprising:

engaging said seal within or below said insert.

8. The method of claim 4, comprising:

engaging a latch on the common fill up and circulating equipment below said insert.

9. The method of claim 4, comprising:

mounting the insert to the topmost tubular in a manner to eliminate a seal between them.

10. The method of claim 4, comprising:

providing a seal between said insert and said topmost tubular.

11. The method of claim 4, comprising:

using a thread protector as said insert.

12. The method of claim 4, comprising:

providing a latch in said common equipment that engages a recess in or below said insert.

13. The method of claim 12, comprising:

removing support for said latch to insert it into said insert.

14. The method of claim 13, comprising:

using fluid pressure to remove support for said latch for insertion into said insert.

15. The method of claim 14, comprising:

removing fluid pressure with said latch to give it support in said recess.

16. The method of claim 15, comprising:

using bias to move said latch onto a support when fluid pressure is removed.

17. A downhole completion method, comprising:

using the same fill up and circulating equipment to sequentially run casing and drill string at different times;

filling, circulating and taking returns sequentially from casing and drill string with the same equipment at different times;

lifting or advancing an entire string while filling, circulating or taking returns through it;

doing said lifting or advancing without elevators or bails.

* * * * *